United States Patent [19]

Johnson

[11] 4,215,638

[45] Aug. 5, 1980

[54] NEEDLE BAR SUSPENSION MEANS FOR A ZIG-ZAG SEWING MACHINE

[75] Inventor: Ralph E. Johnson, Convent Station, N.J.

[73] Assignee: The Singer Company, Stamford, Conn.

[21] Appl. No.: 915,084

[22] Filed: Jun. 12, 1978

[51] Int. Cl.[2] ..... D05B 55/14

[52] U.S. Cl. ..... 112/221

[58] Field of Search ..... 112/221, 73, 109, 158 R

[56] References Cited

U.S. PATENT DOCUMENTS

| | | | |
|---|---|---|---|
| 2,737,134 | 3/1956 | Ashworth et al. | 112/221 X |
| 2,989,016 | 6/1961 | Johnson | 112/221 X |
| 3,426,709 | 2/1969 | Jindrich et al. | 112/73 |
| 3,815,532 | 6/1974 | Weisz et al. | 112/221 |

FOREIGN PATENT DOCUMENTS

| | | | |
|---|---|---|---|
| 49-88964 | 8/1974 | Japan . | |
| 51-103547 | 8/1975 | Japan . | |
| 51-103548 | 8/1975 | Japan . | |
| 458899 | 8/1968 | Switzerland | 112/221 |

*Primary Examiner*—Wm. Carter Reynolds

*Attorney, Agent, or Firm*—Robert E. Smith; William V. Ebs; Edward L. Bell

[57] ABSTRACT

The needle bar of a sewing machine is mounted in a spherical bearing which is located adjacent the lower end of a needle bar bracket. The bearing is pivoted as a gate in the frame of the machine and the bracket is pivoted as a pendulum at its upper end to fixed structure in the machine head for movement in mutually perpendicular directions.

4 Claims, 5 Drawing Figures

NEEDLE BAR SUSPENSION MEANS FOR A ZIG-ZAG SEWING MACHINE

BACKGROUND OF THE INVENTION

1. Field of the Invention

The invention is directed to needle bar suspension means for use in a zig-zag sewing machine.

2. Description of the Prior Art

It is known in the design of suspension means for the needle bar of a sewing machine to utilize pendulum and gate type geometry enabling the sewing needle to follow the arc of the hook of the machine as required for zig-zag sewing. More particularly, it is known, as disclosed for example in Japanese Pat. Nos. 88964 and 3048.61 of Aug. 1, 1974 and Feb. 4, 1963 respectively, to pivotally connect a needle bar supporting bracket as a pendulum at its upper end to the frame of a machine, and to provide the needle bar with a movable bearing which is pivoted as a gate on the machine and causes the needle to follow a curved path when the needle bar supporting bracket is articulated. Prior art needle bar suspension means providing for arcuate movement of the needle arc, however, deficient in various respects, as for example, in durability, in their control of needle movement and in that they are costly to manufacture.

SUMMARY OF THE INVENTION

In accordance with the invention, the needle bar supporting bracket of a sewing machine is mounted in simple fashion at its upper end for pivotal motion as a pendulum about the axis of a supporting shaft, and the needle bar reciprocable therein is provided at a point just under the lower end of the bracket with a spherical bearing which is pivotally mounted for movement as a gate in the machine. The upper end of the needle bar supporting bracket is provided with transversely spaced feet which engage the frame of the machine and serve both to define a second pivotal axis for the bracket perpendicular to its supporting shaft, and to stabilize movements of the bracket by preventing it from twisting on its own axis. The needle bar supporting bracket moves as a compound pendulum and since it can not twist, the needle bar supported in the bracket is always oriented as required for a needle affixed in the needle bar to properly form loops in cooperation with a loop taker.

DESCRIPTION OF THE PREFERRED EMBODIMENT

Figure 1:
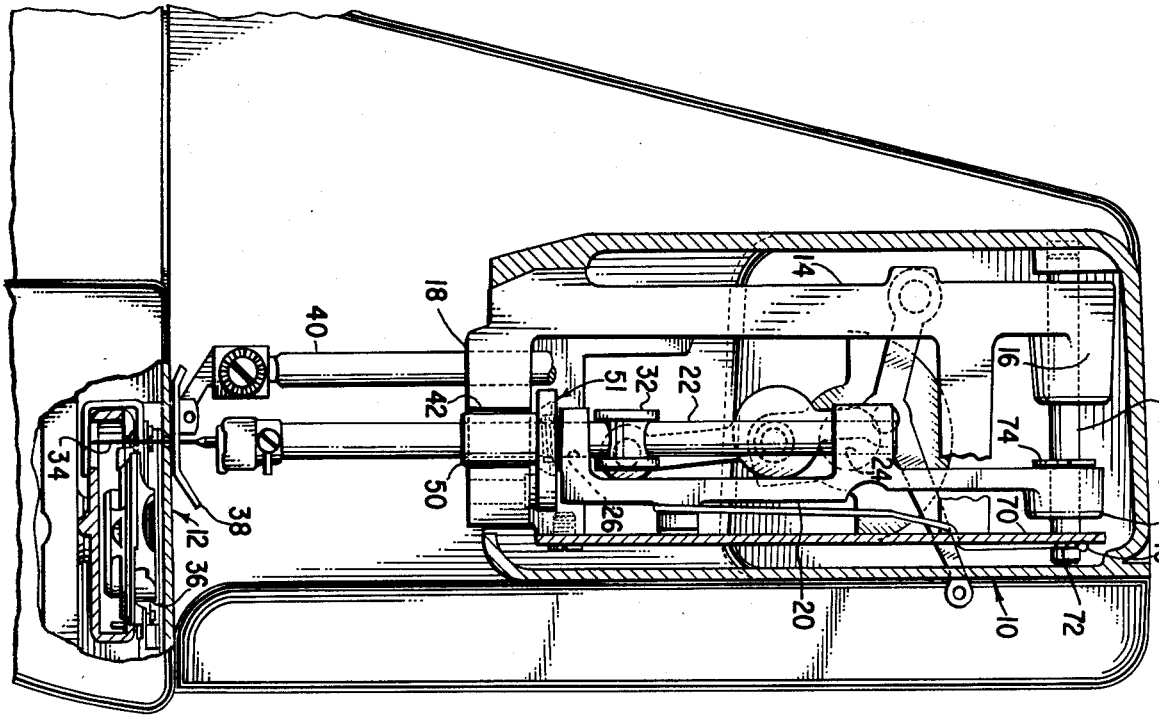
FIG. 1 is a head end elevational view shown partially in section and with the end cover removed of a sewing machine according to the invention.
Figure 2:
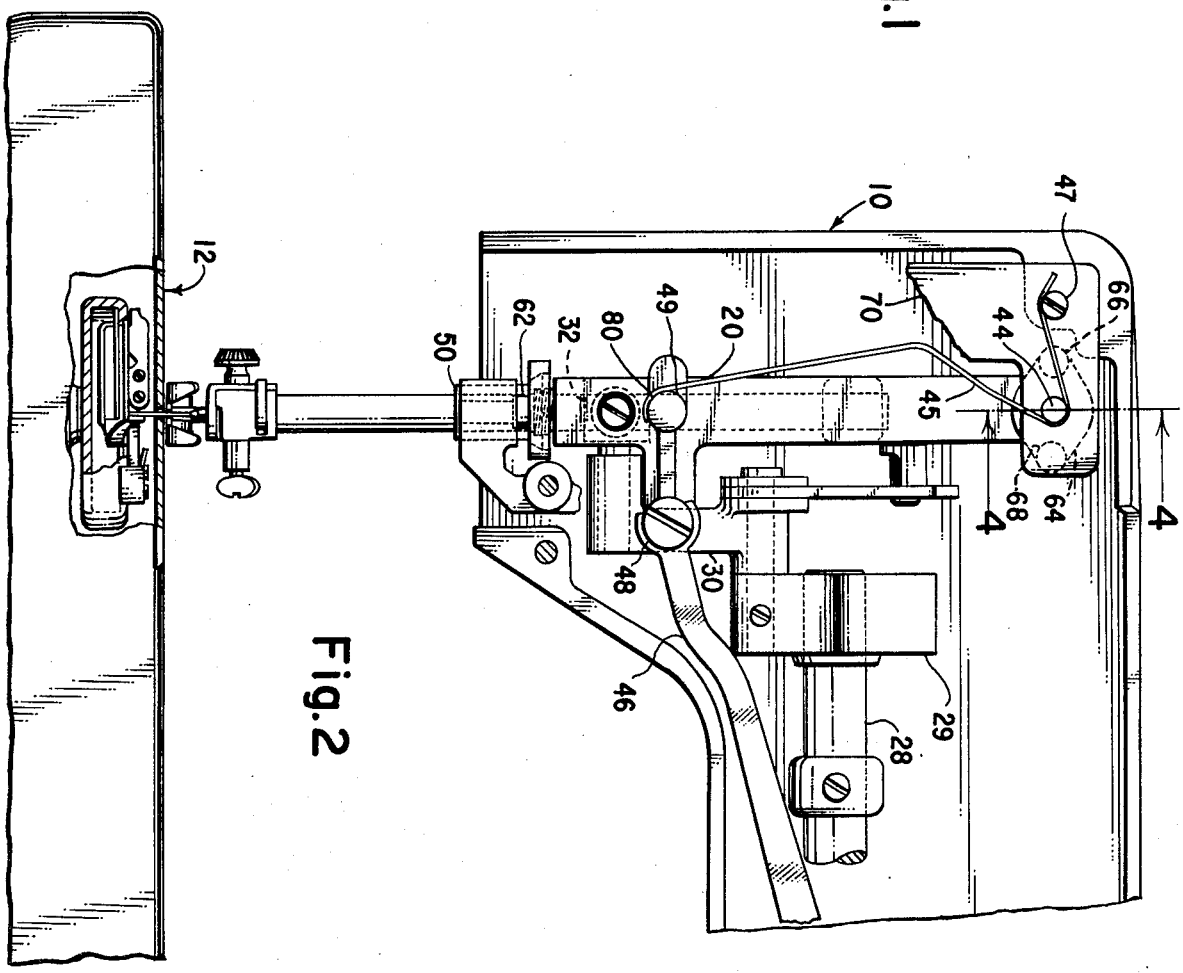
FIG. 2 is a front elevational view of the head end portion of the sewing machine of FIG. 1 with the covers removed.

Referring to the drawings, and in particular to FIGS. 1 and 2 thereof, reference characters 10 and 12 designate the head end portion and work supporting bed portion respectively of a zig-zag sewing machine according to the invention. The head end portion includes a fixed support bracket 14 having an upper extending arm 16 and a lower extending arm 18 which support a needle bar bracket 20.

A needle bar 22 is supported in bracket 20 at 24 and 26 for endwise reciprocation by a rotating arm shaft 28 acting through a crank 29, link 30 and needle bar collar 32. Attached to the lower end of the needle bar 22 is a needle 34 which cooperates with a loop taker 36 in the bed of the machine. A presser foot 38, affixed to a presser bar 40, is utilized to urge fabric into contact with feeding mechanism (not shown). The needle bar 22 extends through an elliptical opening 42 in arm 18 of fixed bracket 14, which opening is of sufficient size to permit zig-zag movements of the needle bar in response to reciprocatory actuation of the needle bar supporting bracket 20 by needle bight control means causing the bracket to pivot at its upper end on a shaft 44. The needle bight control means is entirely conventional and therefor has not been illustrated except for an actuating link 46 shown pivotally connected to bracket 20 at 48, and a return spring 45 having one end restrained by a screw 47 at a fixed location in the machine and having the other end in engagement with an abutment 49 on bracket 20.

Figure 3:
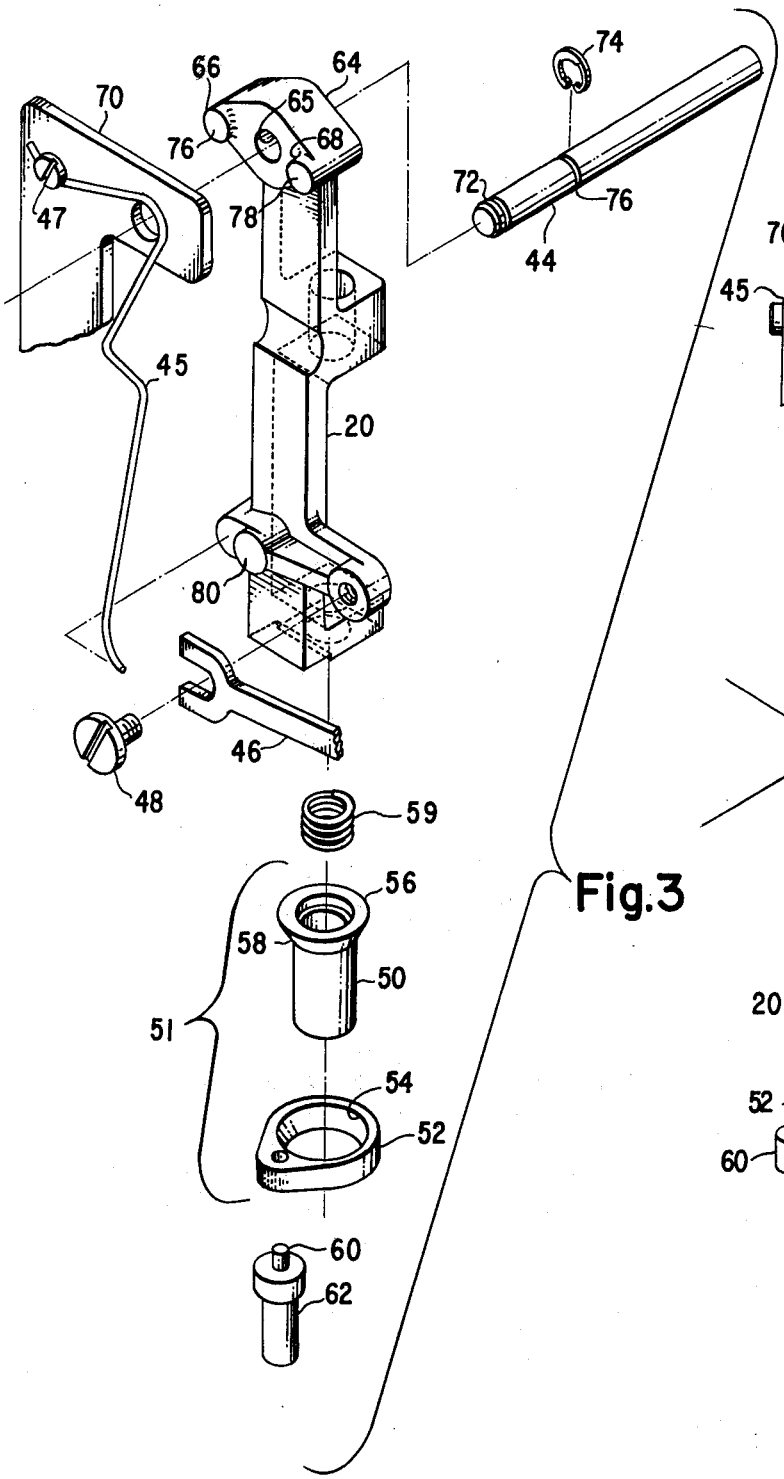
FIG. 3 is an exploded perspective view of the needle bar supporting bracket and associated parts of the sewing machine of FIGS. 1 and 2.
Figure 4:
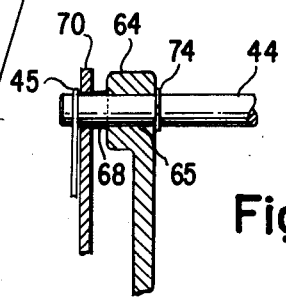
FIG. 4 is a vertical sectional view taken on the plane of the line 4—4 of FIG. 2.

Needle bar 22 is supported between the lower end of bracket 20 and arm 18 of fixed bracket 14, in the sleeve 50 of a spherical bearing 51 (see FIG. 3). Such bearing includes a collar 52 with a spherical inner surface 54 and a rim 56 on the sleeve 50 with a spherical outer surface 58 in engagement with spherical surface 54 of the collar. A spring 59 between the lower end of bracket 20 and sleeve 50 maintains the spherical surfaces 54 and 58 in enforced engagement. Collar 52 is pivoted on a pin 60 which is an integral part of a member 62 that is affixed in arm 18 of bracket 14.

The needle bar supporting bracket 20 includes an enlarged upper end portion 64 having a through hole 65 on the longitudinal axis of the bracket to receive shaft 44, and having transversely spaced cylindrical feet 66 and 68 formed on opposite sides of the hole, the hole 65 and the feet 66 and 68 being disposed with their axis parallel in a common horizontal plane. Shaft 44 which provides a pivotal axis for needle bar supporting bracket 20 extends through hole 65 and is supported in arm 16 of fixed bracket 14 and in a fixed plate 70. Return spring 45 engages shaft 44 in a groove 72 and prevents the shaft from being moved axially. A spring washer 74 in a groove 76 on the shaft maintains bracket 20 disposed with its feet 66 and 68 in contact with fixed plate 70.

Figure 5:
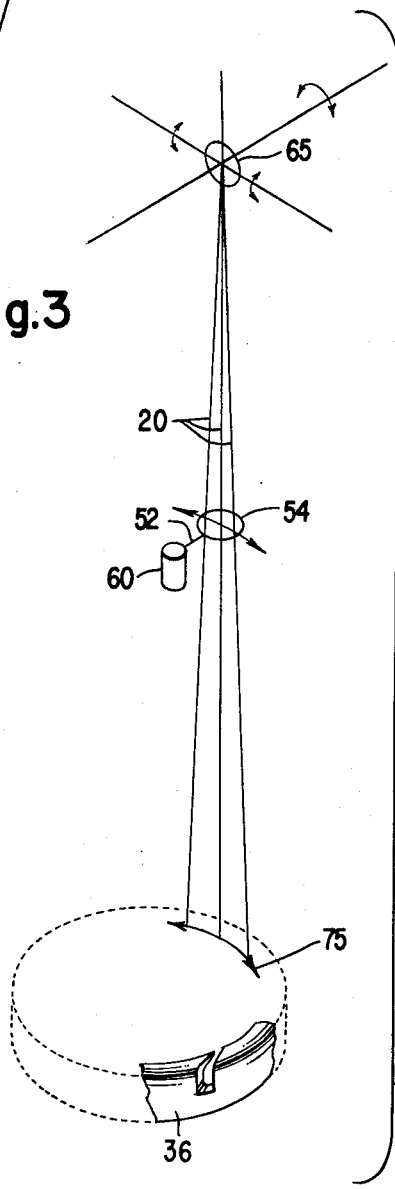
FIG. 5 a schematic drawing illustrating movement of the needle bar and needle of the said sewing machine.

Actuating link 46 and return spring 45 move needle bar supporting bracket 20 in opposite directions on shaft 44, the result of which is that zig-zag movements are imparted by bracket 20 to the needle bar 22 and therefor to the sewing needle 34. Pivoted spherical bearing 51 confines the movement of the lower end of bracket 20 to an arcuate path and causes needle 34 to follow the circular arc 75 of needle loop taker 36 (See FIG. 5). The needle bar supporting bracket 20 pivots about mutually perpendicular axes which are also perpendicular to the longitudinal axis of the bar, that is mainly about the axis of shaft 44, but also slightly against plate 70 on the feet 66 and 68 about a transverse axis through the feet, sufficient clearance being provided between shaft 44 and hole 65 to accommodate the movement about the transverse axis. Any slight tendency of the bracket to twist about its longitudinal axis is resisted by a reactant force exerted by plate 70 against one or the other of the feet 66 and 68 depending upon the direction of the twisting torque. The needle 34 is thereby prevented from twisting and therefor always remains oriented throughout its zig-zag motion as required for it to properly form loops in cooperation with loop taker 36.

Although the feet 66 and 68 on upper end portion 64 of bracket 20 have been described and illustrated in the drawing as being cylindrical in form and having flat end surfaces 76 and 78 respectively in contact with plate 70, it is to be understood that other axially symmetrical shapes might be employed for these parts and that the plate contacting surfaces may be rounded rather than flat. However, a manufacturing advantage is realized by forming flat contacting surfaces on the feet in a common plane with and a third flat surface 80 on the bracket 20 before drilling holes in the part, since such flat surfaces may be used to stabilize the position of the part in a holding jig which may then be employed to facilitate the drilling operations.

Although the invention has been described with a certain degree of particularity, it is to be understood that the present disclosure has been made by way of example, and that numerous changes in the details of construction and combination of parts may be resorted to without departing from the spirit and scope of the invention.

Having thus set forth the nature of the invention, what is claimed herein is:

1. In a zig-zag sewing machine, the combination comprising, a needle bar, a needle affixed to the lower end of the needle bar, a needle bar supporting bracket having the needle bar mounted for reciprocation therein, a spherical bearing for the needle bar located between the upper and lower ends thereof and mounted for pivotal movement in the machine, and means mounting the needle bar supporting bracket at the upper end portion thereof for pivotal motion about mutually perpendicular axes which are also perpendicular to the longitudinal axis of the bracket, said means including a hole in the upper end portion of the needle bar supporting bracket with a shaft extending therein to define a primary pivotal axis for the bracket, feet on opposite sides of the longitudinal axis of said bracket and a fixed member which engages the feet and prevents the bracket from twisting about the said longitudinal axis.

2. The combination of claim 1 wherein the shaft defining a primary pivotal axis for the bracket is supported at least in part in the fixed member engaging the feet on the bracket.

3. In a zig-zag sewing machine, the combination comprising, a needle bar, a needle affixed to the lower end of the needle bar, a needle bar supporting bracket having the needle bar mounted for reciprocation therein, a spherical bearing for the needle bar located between the upper and lower ends thereof and mounted for pivotal movement in the machine, and means mounting the needle bar supporting bracket at the upper end portion thereof for pivotal movement about mutually perpendicular axes which are also perpendicular to the longitudinal axis of the bracket, said means including cylindrical feet with flat end surfaces on opposite sides of the longitudinal axis of the bracket, and a fixed plate which engages the flat end surfaces of the feet to prevent the bracket from twisting about the said longitudinal axis.

4. The combination of claim 3 including an additional flat surface on the bracket in a common plane with the flat end surfaces of the feet.

* * * * *